United States Patent [19]

vom Braucke et al.

[11] Patent Number: 5,014,461

[45] Date of Patent: May 14, 1991

[54] STAND, IN PARTICULAR FOR CHRISTMAS TREES

[75] Inventors: Manfred vom Braucke, Bielefeld; Hans vom Braucke, Vlotho, both of Fed. Rep. of Germany

[73] Assignee: Bielefelder Küchenmaschinen- und Transportgeräte-Fabrik vom Braucke GmbH, Bielefeld, Fed. Rep. of Germany

[21] Appl. No.: 442,646

[22] Filed: Nov. 28, 1989

[30] Foreign Application Priority Data

Nov. 29, 1988 [DE] Fed. Rep. of Germany ..... 8814845

[51] Int. Cl.[5] ..... A01G 9/12

[52] U.S. Cl. ..... 47/40.5; 248/523; 248/529

[58] Field of Search ..... 47/39, 40.5, 42, 43; 248/523–527, 529, 519

[56] References Cited

U.S. PATENT DOCUMENTS

| | | | |
|---|---|---|---|
| 1,005,750 | 10/1911 | Schwaderer . | |
| 1,680,050 | 8/1928 | Keppens . | |
| 1,694,815 | 12/1928 | Garlick . | |
| 2,242,270 | 8/1938 | Sims | 47/40.5 |
| 2,681,780 | 6/1954 | Santoro | 47/40.5 |
| 2,905,414 | 9/1959 | Zierden | 47/40.5 |
| 3,484,067 | 12/1969 | Fulper . | |
| 3,715,095 | 2/1973 | Drablowski | 47/40.5 |
| 4,825,586 | 5/1989 | Coppedge | 47/40.5 |
| 4,848,027 | 7/1989 | Skierwiderski | 47/39 |

FOREIGN PATENT DOCUMENTS

| | | |
|---|---|---|
| 1778031 | 8/1958 | Fed. Rep. of Germany . |
| 7247527 | 5/1973 | Fed. Rep. of Germany . |
| 8235405 | 8/1983 | Fed. Rep. of Germany . |

*Primary Examiner*—David A. Scherbel
*Assistant Examiner*—Michele A. Van Patten
*Attorney, Agent, or Firm*—Burns, Doane, Swecker & Mathis

[57] ABSTRACT

A stand for holding plants and trees comprises a holder including an upright tubular portion adapted to hold a lower end of a tree trunk, and at least three support legs joined to the tubular portion. The legs are arranged to space a lower end of the tubular portion above a support surface. A water container is positioned beneath the tubular portion. Upper and lower sets of circumferentially spaced fastening screws are disposed in vertically spaced upper and lower planes, respectively, such that radially inner ends of the screws are able to support and align a lower end of a tree trunk. Each fastening screw is disposed approximately midway between two circumferentially adjacent ones of the legs as the stand is viewed from above.

13 Claims, 4 Drawing Sheets

Fig. 2
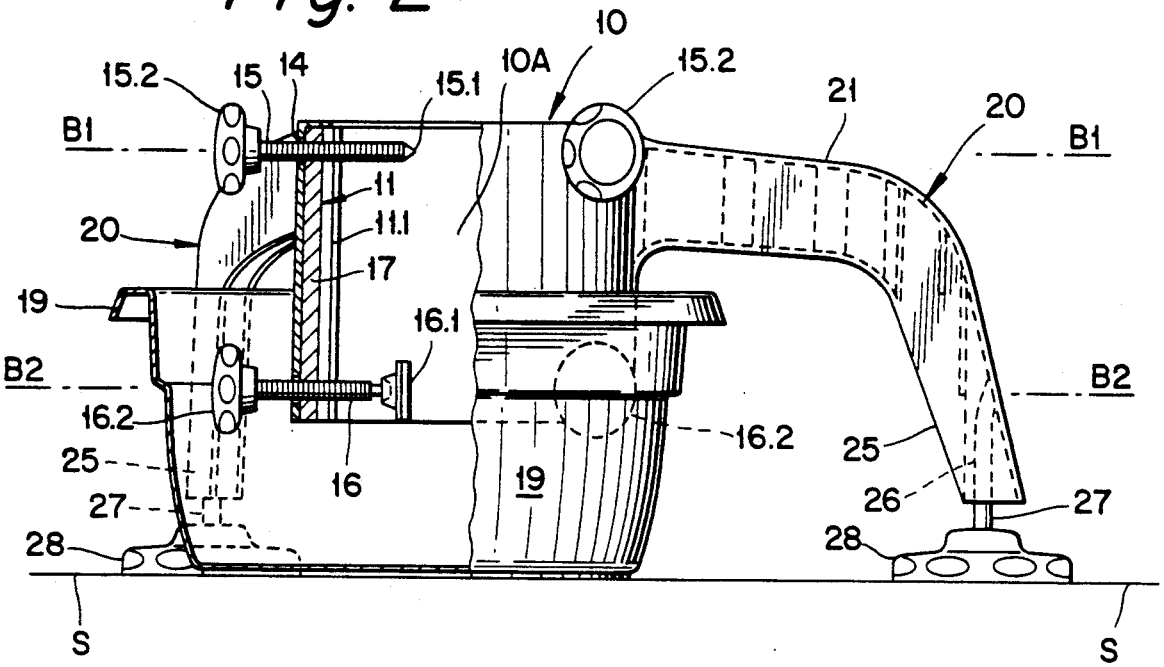
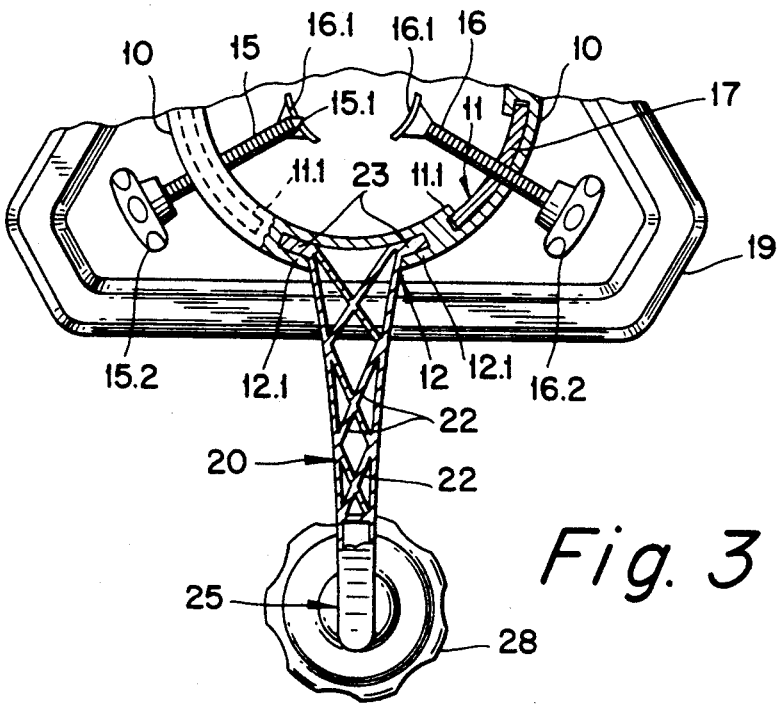
Fig. 3

STAND, IN PARTICULAR FOR CHRISTMAS TREES

BACKGROUND OF THE INVENTION

The invention concerns a stand, in particular for Christmas trees, especially to a stand which comprises a holder, support legs, and a water container. The holder includes a tubular portion through which fastening screws project to support a tree trunk, the latter extending into the water container.

Different types of stands are known for the setting up of trees for decorative purposes, such as for example Christmas trees or maypoles.

According to one proposal (see U.S. Pat. No. 1,005,750), the tree trunk is set into a stand equipped with outwardly projecting support legs after tightly clamped fastening rings have been set onto the trunk. The rings are located above and below a tubular holder and together immobilize the tree on the stand.

According to another proposal (see U.S. Pat. No. 1,680,050) the tree trunk is held by a clamping device mounted on a lower stand having outwardly projecting support legs. The clamping device is equipped with two open clamping rings independently adjustable in height; the free end of the trunk is set into a water vessel.

Disclosed in U.S. Pat. No. 1,694,815 a stand has outwardly projecting removable support legs, and the tree trunk is set into a cup-shaped holder, with the end of the trunk resting on the bottom f the holder. The inserted end of the trunk is then tightly clamped by clamping screws located in two vertically spaced planes. The holder is set rotatingly onto the stand.

Other stands are known in which the lower trunk end is introduced into a holder (see for Example German GM-17 78 031), with the trunk end resting in the area of the lower end of a tubular holder and being clamped by means of a plurality of fastening screws in the area of the upper end of the holder. The holder is set on a stand equipped with support legs, the distance of radial projection of which determines the bearing strength of the stand. In this design an attempt is made to support the weight of the trunk by setting it onto the stand and to align the trunk erected in this manner by means of the fastening screws located at one end of the holder and to secure it in the aligned position. A disadvantage involves the fact that the alignment can be effected only with difficulty, as the bottom support is not point-shaped and cannot be assumed to be axial; the irregularities of the growth of the tree render a satisfactory alignment of the trunk difficult.

It has, therefore, already been proposed (see German GM-82 35 405) to equip the holder with a plurality of fastening screws located in vertically spaced planes. The lower end of the trunk is tightly clamped by several fastening screws provided in the lower plane of the trunk holder, while the screws in the upper plane are initially used to align and then additionally clamp the trunk.

It is further known to equip the tree stand with three support legs in order to utilize the tilting security of the three-point support.

It has also been proposed (see German Document GM-72 47 527) to place the entire stand for a Christmas tree into a vessel filled with water to prevent drying and to keep the tree fresh.

The present invention constitutes an improvement over the above-described state of the art. An object of the invention is to provide a stand of the afore-mentioned type so that the clamping and alignment may be performed simply; wherein the tree stand itself is light and may be produced economically with reduced material requirements, while displaying the necessary stability; and making it possible to provide water in order to keep the tree fresh, the tree being packaged in a space saving manner, so that additional decorations are possible.

SUMMARY OF THE INVENTION

In accordance with the present invention a stand is provided for holding plants and trees. The stand comprises a holder which includes an upright tubular portion adapted to hold a lower end of a tree trunk. At least three support legs are joined to the tubular portion and are circumferentially spaced apart by equal distances. Each support leg includes inner and outer portions. Each inner leg portion projects generally radially outwardly from an upper end of the tubular portion. The leg outer portion projects downwardly. The legs are arranged to face a lower end of the tubular portion above a support surface, such as a floor. The stand includes a water container positioned beneath a tubular portion. Upper and lower sets of circumferentially spaced fastening screws are disposed in vertically spaced upper and lower planes, respectively, located adjacent respective ends of the tubular portion. Radially inner ends of the sets of fastening screws are able to support and align a lower end of a tree trunk. The upper set of fastening screws are superimposed below the lower set. Each fastening screw is disposed approximately mid-way between two circumferentially adjacent ones of the legs, as the stand is viewed from above.

By means of the support legs joined to the upper end of the tubular portion, the latter is suspended by the legs, so that the tree carried by the holder, whether a Christmas tree, a maypole or the like, or any other tall growing plant set up for decorative purposes, may be held securely. This hold is independent of the number of support legs, provided that there are at least three legs, whereby the legs can always be set onto a support plane without tilting.

If the support plane deviates from an ideal plane or if the stand has more than three support legs, freedom from tilting may be secured by means of independently height adjustable feet.

In order to utilize the available space efficiently, the water container is in the basic shape of an equilateral triangle. To obtain a pleasing appearance of the holder, the corners may be rounded and the walls stepped and the upper edge rounded, which simultaneously represents a rigidizing means. Lateral walls are laid out in three 120° arcs, the center of curvature of which is located in the opposite corner point of the triangle, which is spherical and is often designated of "equal thickness" again make possible a pleasing layout of the water container.

The tubular portion of the holder comprises a plurality of fastening screws located in two fastening planes above each other, always in the center between two fastening legs. In this manner, the screw heads, provided in the form of handle knobs are readily accessible. These fastening screws (three in the case of three support legs) are spaced apart angularly equally. In this layout the "corners" of an essentially triangular water container located at the bottom form the projections which in the area of the water container hold the lower fastening screws.

To be able to hold and align a tree without appreciable difficulties, some of the fastening screws have cones or tips which are able to penetrate into the trunk. The screws penetrating into the trunk absorb the weight of the tree and transfer it to the holder. However, the alignment of the tree would be at least rendered more difficult by this penetration of the fastening screws into the trunk. For this reason, some of the fastening screws, preferably the lower ones nearer to the support plane, are provided with a support plate resting against the outside of the tree.

To make possible the securement of the fastening screws in the holder, vertically or axially parallel grooves are provided in the wall of the tubular portion into which inserts are placed that contain threaded holes for the fastening screws. The grooves accepting these inserts are provided with backed off edges which accept inserts, such as groove blocks wherein a dove-tail like configuration of the backed off edges facilitates the introduction of the inserts. The tubular portion includes passage holes corresponding in location to the threaded holes, through which the fastening screws are passing. Screw heads located on the outside of the screws make possible the tightening and releasing of the fastening screws. Following the insertion of the screws, the upper screws are tightened, whereupon the cones or tips penetrate into the trunk and transmit the force of gravity to the holder, whereby the inserts are pressed outwardly abut against the inner wall of the groove to be held by friction. By means of the abutment of the fastening screws against the lower inner wall of the passage holes and the frictional lock created in this manner, the weight is introduced securely into the tubular portion and transmitted from there to the support legs. The inserts may be supported against a peripheral impact, which would further improve the transfer of the force.

Another possible mode of introduction of the force to be transferred involves a wedge-like configuration of the grooves, wherein the inner and outer faces of the insert converge in a downward direction, i.e., the thickness of the wedge decreases in the downward direction. The upper edges of the inserts would rest against the grooves, the latter forming stops for the inserts whereby the passage holes would be relieved of loading, and the force transfer would become independent of a frictional hold. The wedge shape is laid out so that the force transferred to the inserts and directed downward draws the latter into their seat. To make possible a closed appearance of the stand, an annular cover would be provided to overlie the upper edge of the tubular portion, or the inserts to be introduced from the upper edge of the holder could be in the form of a snap-in closure.

The support legs are connected in one embodiment as a single integral piece with the tubular portion. In another embodiment, the holder is provided with additional grooves similar to the grooves accepting the inserts for the fastening screws, but the additional grooves are open to the outside, and the support legs have terminal plates on their sides facing the holder, which may be set into the grooves. Here again, the grooves have backed-off edges, preferably in a dove-tail shape. The terminal plates of the support legs are set into the grooves in a positively locking manner. A wedge-shaped groove configuration is provided wherein the edges of the insert converge from bottom to top in order to improve the transfer of force from the holder to the support legs. Accordingly, the tubular portion is slid onto the terminal plates in a positively held manner, because the forces being transmitted are acting vertically from top to bottom.

In order to be able to align the support legs, the outer free ends of the radial parts are angled off in an approximately axially downward point fashion to define a downward leg part equipped with a seat for a foot adjustable in height when screwed in or out. The screw threading may be inserted directly into the leg free end, with a threaded bushing making possible a material saving configuration of the free end of the support leg. The adjusting foot is preferably equipped with an adjusting plate. This adjusting plate, if large enough, displaces the fulcrum line so as to achieve non-tiling security of two adjacent adjusting plates appreciably to the outside, thereby increasing the stability of the stand, without an increase in the projection. The diameter of the adjusting plate amounts to at least $\frac{1}{3}$ of the projection of the support leg. As the stored stand usually has no screwed-in support legs which are packed in loose form, this advantageously affects the size of the package.

The stand is produced advantageously in the form of a die cast or injection molded part. For a production as a die cast part, the known die casting alloys, in articular those used in the casing of light metals may be used. This makes it possible to obtain a metal stand that can be manufactured by an economical production method. Alternatively, it is possible to produce the stand in the form of an injection molded part, wherein the plastic to be used may be chosen in keeping with the requirement. Fiber reinforced plastics are especially suitable for highly stressed parts.

In order to make possible the production of the stand by the die casting or injection molding process, the profile of the support legs is in the form of a downwardly open "U" as reviewed in cross-section. Transverse reinforcing elements may be provided between the legs of the "U" for stiffening the structure. The vertical transverse walls are preferably set at an angle relative to each other, so that supporting connections crossing each other are formed. The downwardly bent end of the support legs may be adapted in this production method in a simple manner to hold a threaded bushing receiving the support legs.

As the stand is laid out for maximum trunk diameters, the setting up of trunks with smaller diameters or the arrangement of tall growing plants in the stand may be difficult. To avoid this problem, a cylindrical insert to be placed in the holder is provided and is secured in the holder by fastening screws. The cylindrical insert has a cover plate comprising a hole. This hole makes it possible to insert a trunk with a small diameter, for example a young birch as a maypole. Tall specimens of plants may also be set up in this manner, for example sunflowers. If the cover plate is provided with several holes, arrangements of plants may be prepared using the stand, wherein the plants are also supplied the water needed to keep them fresh by the water vessel, which may also hold low ground cover plants to round out the arrangement.

BRIEF DESCRIPTION OF THE DRAWING

The objects and advantages of the invention will become apparent from the following detailed description of preferred embodiments thereof in connection with the accompanying drawings,, in which like numerals designate like elements, and in which:

FIG. 2 is a lateral elevational view of the stand (partial in section);

FIG. 3 is a fragmentary plan view of a modified embodiment of the stand in partial section:

DETAILED DESCRIPTION OF PREFERRED EMBODIMENTS OF THE INVENTION

Figure 1:
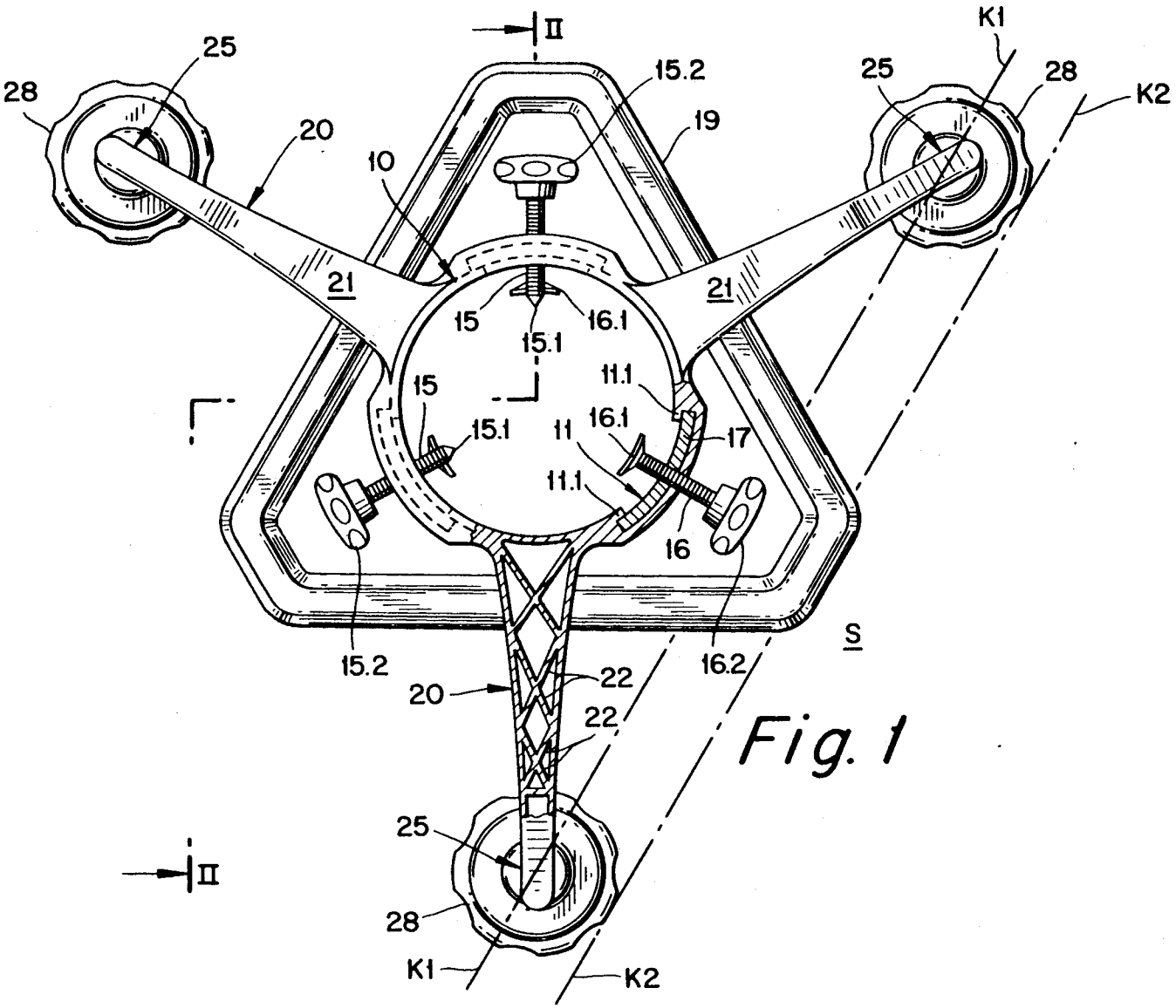
FIG. 1 is a top elevational view of a stand according to the invention, a holder portion of which being partly in section.

FIG. 1 shows in a top view a stand according to the present invention resting on a support plane S such as a floor surface. The stand comprises a trunk holder 10 which includes a tubular portion 10A, and three support legs 20 spaced apart by 120° angles from each other and projecting essentially radially outwardly. Between the support legs are located upper fastening screws 15 in an upper horizontal plane B1 and lower fastening screws 16 in a lower fastening plane B2. The screws 15 are circumferentially spaced apart by 120° and are offset by 60° from the support legs 20, so that the screw heads 15.2 are located between the support legs 20 and are readily accessible. The same is true of the lower screws 16 which are vertically superimposed relative to the upper screws 15. The upper fastening screws 15 are intended essentially to secure the tree; they carry the tree weight and are therefore equipped for example with pointed tips 15.1 penetrating into the trunk.

In contrast, the lower fastening screws 16 are provided essentially for the alignment of the tree set into the stand; they have plates 16.1 located against the end of the trunk to improve the transfer of the forces required for alignment. Also, the plates prevent the penetration of the lower fastening screws 16 into the trunk.

The tubular portion 10A is equipped with downwardly open grooves 11 spaced apart angularly by 120°, into which can be slid dove-tail shaped inserts 17 that carry threaded holes intended to receive the threads of the fastening screws 15, 16.

Figure 6:
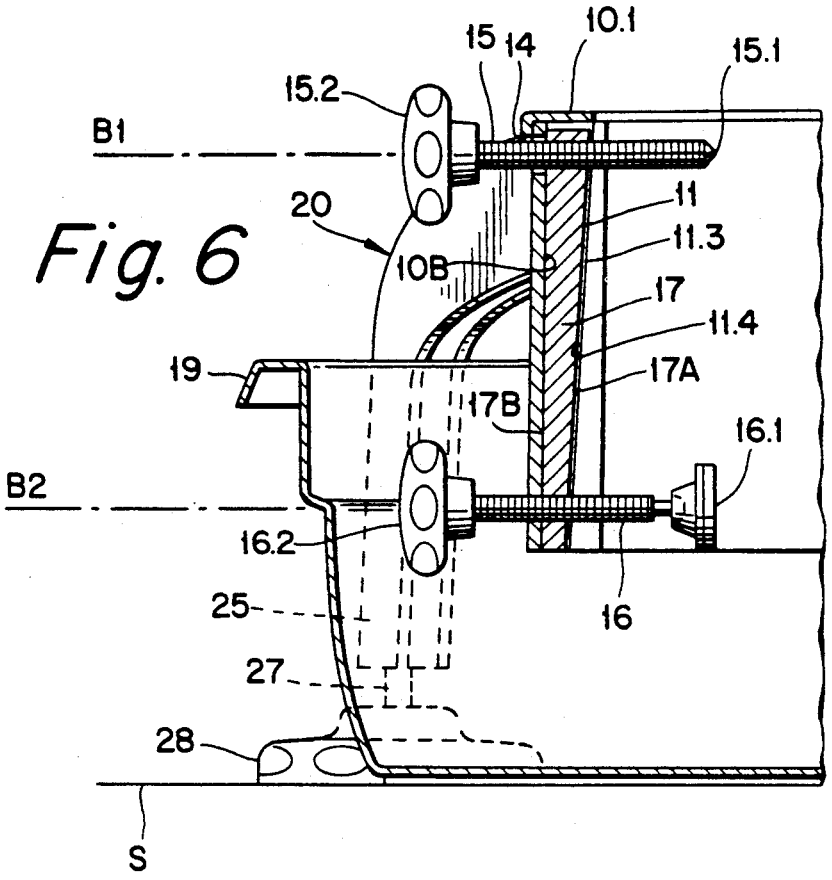
FIG. 6 is a view similar to FIG. 2 depicting one type of wed insert.

The inserts 17 can be tapered or wedge shaped as depicted in FIG. 6 wherein inner and outer surfaces 17A, 17B of the insert converge downwardly. The faces 11.4 of the edges 11.1 of the grooves also converge downwardly relative to the opposing face 10B of the tubular portion. The inserts would be inserted from the top, and the downwardly converging surfaces 11.4 of the groove would form stop surfaces against which the inserts come to rest. The inserts 17 are held against radial dislodgement from the grooves 11 by the overlapping edges 11.1 of the holder. The tubular portion 10A is provided with passage holes 14 (FIG. 2) corresponding to the threaded holes of the inserts 17, so that the fastening screws 15 and 16 may be readily passed through and tightened to hold and align the tree. In addition, the inserts 17 are pressured by the fastening screws 15 and 16 in the tightened state against the outer wall of the grooves 11; the frictional lock created in this manner transfers the gravity force applied by the weight of the tree through the holder to the stand.

In order to maintain the top side of the tubular portion 10A free of protuberances, an upper cover ring 10.1 is provided, which may be integral in one piece with the tubular portion 10A. This is possible if the inserts 17 are inserted from the bottom side of the tubular portion 10A. In the case in which this is not possible, for example because of a downward insertion of the inserts, a separate upper cover ring 10.1 may be installed afterwards, for example by means of a snap-in lock.

The support legs 20 are directed essentially radially outward as viewed from the top. The legs comprise radial inner portions 21 and outer portions 25 which extend downwardly and outwardly. At least the radial parts 21 are shaped in cross-section as downwardly open U-shapes and have transverse reinforcing beams 22 located in the internal free space (FIG. 2). The outer ends 25 of the legs are equipped at their outer ends with adjusting feet 27 capable of being screwed in and out (FIG. 2). The feet 27 include ground support plates 28. Those plates 28 have a diameter of about ⅓ of the distance between the central vertical axis of the tubular portion and the center vertical axis of the plate 28. The outer peripheries of the plates define a tilting fulcrum K2 which is spaced outwardly from a fulcrum K1 which would exist in the absence of the plates 28, whereby the distance of the tilting fulcrum K2 from the central vertical axis is increased by about 35 percent. Also, by means of the plates, in addition to another alignment possibility of the stand (which in view of its three leg support is always free of tilting) an increase in the righting moment effectively prevent tilting, is also obtained.

The three-leg support design maintains the tubular portion 10A above the surface S and makes possible the simple insertion of the tubular portion 10A into a water container 19 to keep the tree fresh. It is advantageous to shape the water container as an equilateral triangle; in that case, the water container 19 can be rotated about the vertical center axis by 60° relative to the support legs 20 without colliding with the plates 28 and without interfering with the free access to the rotating knobs 16.2 of the lower fastenings crews, for example for realignment.

FIG. 2 shows a partially sectioned view of the stand according to the section line II—II shown in FIG. 1. The vertically spaced parallel fastening planes B1 and B2 are essentially parallel to the support plane S. In both of these fastening planes B1 and B2 the fastening screws 15 and 16 are located; they pass radially through the trunk holder 10. The lower fastening screws 16 carry the plates 16.1, which may be applied against the trunk to provide a frictional lock therewith. The rotating heads 15.2 and 16.2 (the latter situated within the water container 19) make possible the tightening and release of the fastening screws 15 and 16 holding and aligning the tree.

Figure 7:
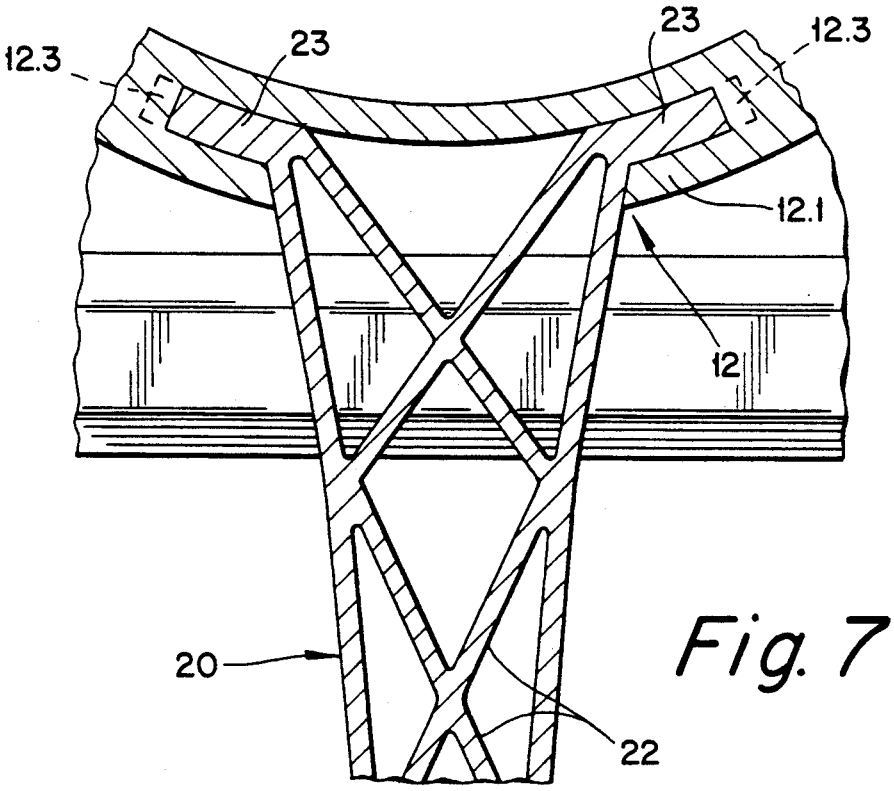
FIG. 7 is an enlarged fragmentary horizontal sectional view showing another wedge shape of the insert and groove.

FIGS. 3 and 7 show another preferred embodiment of the invention, in which the support legs 20 are removable. The tubular portion 10A is provided with angularly spaced grooves 11 and 12 (angularly spaced by 60 degrees) which open alternatingly to the inside and the outside. Into the inward opening grooves 11 the inserts 17 are inserted. The outwardly opening grooves 12 are intended for the releasable insertion of the support legs 20, the radial parts 21 of which are equipped with an insertion plate 23. The insertion plates 23 are received in a positively held manner by the outward opening grooves 12. The overlapping edges 12.1 of the holder hold the plates 23 in position. The grooves 12 have edges 12.3 of wedge shape, i.e., the edges 12.3 converge upwardly. Thus, the width of the groove (in the circumferential direction) tapers upwardly to enable corresponding tapered plates 23 to be inserted from the bottom. This configuration provides for an extremely space-saving storage mode, which is important both for inventory maintenance in commerce and in households for the user. Both with or without removable support legs, the stand is easy to disassemble and store, especially in the plastic version, and it also offers additional space for example for a decorative pad, other decorations or the like, in which case the package may be designed so that the free spaces in the package contain separate holders for such items.

Figure 4:
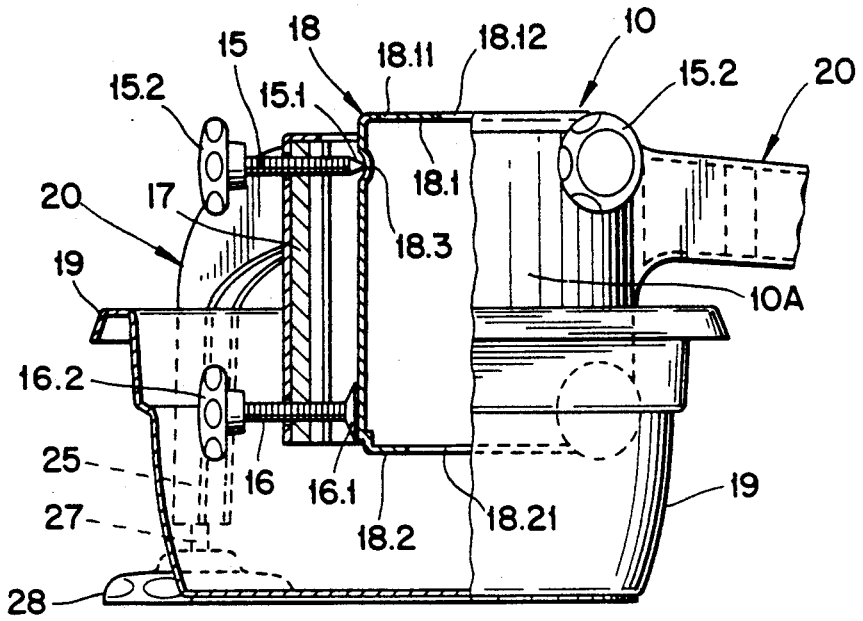
FIG. 4 is a lateral elevation of the stand according to FIG. 2 in partial section and including a cylindrical insert for small plants.

FIG. 4 shows a stand, as shown in FIG. 2. A cylindrical insert 18 is set into the tubular portion 10A. The fastening screws 15 and 16 hold the insert 18 in an upright position, wherein for example to receive the tips of the fastening screws, suitable recesses 18.3 may be provided in the insert 18. An upper cover plate 18.1 of the insert 18 has a plurality of holes, e.g., a center hole 18.11 and a peripheral hole 18.12, through which the small trunks of weak trees or the stalks of tall growing plants may be inserted, in order to obtain an arrangement of plants. In order to provide upright support for high trunks of weak trees, such as maypoles or long stalks of plants, the insert is equipped with a bottom closure plate 18.2, which has one center opening. The free annular space around the insert 18 may be utilized in the same manner; in order to arrange medium height plants opposite the tall plants held directly by the insert 18, they are inserted in the annular space formed between the inner wall of the tubular portion 10A and the outer wall of the insert 18. In a similar manner, short plants completing the arrangement may be set into the water container 19. Depending on the volume of water present in the container, at least the fastening screws 16 of the lower fastening plane B2 are in or near the water, which generally contains salts and other plant nutrient and in which plant metabolic products may accumulate. Such waters could be corrosive to the fastening screws. Such a corrosive attack may be prevented by a suitable selection of material, for example by using stainless steel for the fastening screws. The important aspect of the selection of materials is that no corrosion enhancing galvanic element should be formed between the fastening screws 18 and the insert 17 holding these screws.

Figure 5:
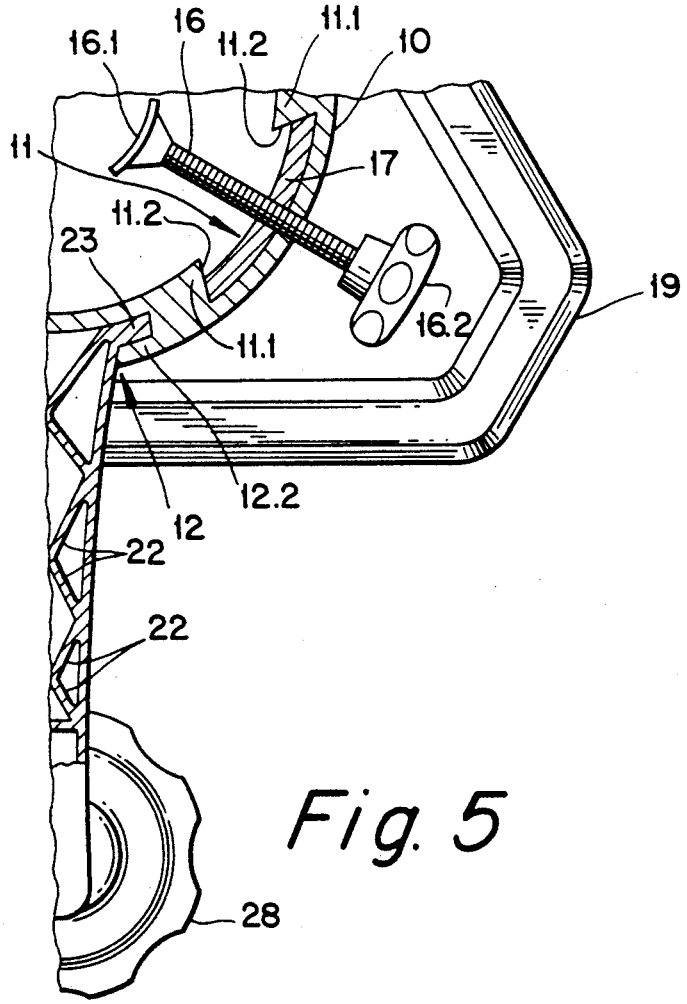
FIG. 5 is a fragmentary horizontal sectional view through the holder depicting a dove-tail configuration of and groove.

It is also desirable to provide the groove/insert edges with a dove-tail configuration to facilitate insertion of the insert. For instance, in FIG. 5 the edges 11.1 of the groove 11 have dove-tail faces 11.2 (i.e., the faces 11.2 converge radially inwardly), and the insert has a corresponding shape.

Although the present invention has been described in connection with preferred embodiments thereof, it will be appreciated by those skilled in the art that additions, modifications, substitutions, and deletions not specifically described may be made without departing from the spirit and scope of the invention, as defined in the appended claims.

What is claimed is:

1. A stand for holding plants and trees comprising a holder including an upright tubular portion injection molded of plastic and adapted to hold a lower end of a tree trunk, and at least three support legs joined to said tubular portion, said legs being circumferentially spaced apart by equal distances, each support leg including inner and outer portions, said inner leg portion projecting generally radially outwardly from an upper end of said tubular portion, said leg outer portion projecting downwardly, said legs arranged to spaced a lower end of said tubular portion above a support surface, said stand including a water container positioned beneath said tubular portion and communicating with a lower end of an interior of said tubular portion, upper and lower sets of circumferentially spaced fastening screws disposed in vertically spaced upper and lower planes, respectively, located adjacent respective ends of said tubular portion, such that radially inner ends of said sets of fastening screws are able to support and align a lower end of a tree trunk, said upper set of fastening screws being superimposed above said lower set, each fastening screw disposed approximately midway between two circumferentially adjacent ones of said legs, as said stand is viewed from above, a plurality of support plates joined to radially inner ends of respective ones of said fastening screws of said upper and lower sets, said tubular portion including a plurality of circumferentially spaced vertical grooves which open radially inwardly and are of wedge shape, a plurality of inserts being correspondingly wedge shaped and removably disposed in respective ones of said grooves, each insert including upper and lower threaded holes for receiving a fastening screw of each of said sets.

2. A stand according to claim 1, wherein said water container is shaped as an equilateral triangle as viewed from above, the corners of said container being rounded.

3. A stand according to claim 1, wherein said tubular portion is provided with additional grooves opening radially outwardly, said legs including plates which are removably insertable into said additional grooves.

4. A stand according to claim 3, wherein each of said outer leg portions has a downwardly open threaded hole and an adjustable foot threadedly mounted in said hole, said foot including a threaded stem and an enlarged plate mounted at the bottom of said stem.

5. A stand according to claim 4, wherein said enlarged plate has a diameter equal to at least $\frac{1}{3}$ of a distance between a vertical center axis of said tubular portion and a vertical central axis of said plate.

6. A stand according to claim 3, wherein each said leg is of inverted U-shape in cross-section and includes reinforcing members interconnecting upright walls of said U-shape.

7. A stand according to claim 1, wherein said wedge shape converges downwardly.

8. A stand according to claim 1, wherein said grooves are open downwardly and said tubular portion includes a wall encompassing a radially outer side of each insert, said wall including apertures aligned with said threaded holes of said inserts.

9. A stand according to claim 1, wherein an upper end of said tubular portion includes an annular cover overlying said grooves.

10. A stand according to claim 1, wherein said wedge shape converges upwardly.

11. A stand according to calim 1 including a cylindrical insert insertable into said tubular portion, said tubular portion including a cover plate with at least one hole therein for receiving a plant.

12. A stand according to claim 1, wherein said legs are die cast of metal.

13. A stand according to claim 1, wherein said tubular portion is injection molded of fiber-reinforced plastic.

* * * * *